United States Patent [19]

Hedgpeth

[11] Patent Number: 4,895,129

[45] Date of Patent: Jan. 23, 1990

[54] PEEP SIGHT WITH PEEP TURNER FOR A BOW

[76] Inventor: Roger G. Hedgpeth, 3205 S. Campbell, Springfield, Mo. 65807

[21] Appl. No.: 303,250

[22] Filed: Jan. 30, 1989

[51] Int. Cl.[4] ..... F41B 5/00; F41G 1/00

[52] U.S. Cl. ..... 124/87; 124/90; 124/91; 33/265

[58] Field of Search ..... 124/87, 90, 91; 33/265

[56] References Cited

U.S. PATENT DOCUMENTS

| | | | |
|---|---|---|---|
| 3,199,502 | 8/1965 | Stonecipher | 124/87 |
| 3,410,644 | 11/1968 | McLendon | 33/265 |
| 3,703,770 | 12/1972 | Sofield | 33/265 |
| 3,703,771 | 11/1972 | Saunders | 124/90 |
| 3,859,733 | 1/1975 | Chesnick | 33/265 |
| 3,942,507 | 3/1976 | Opal | 124/30 |
| 4,011,853 | 3/1977 | Fletcher | 124/87 |
| 4,116,194 | 9/1978 | Topel | 124/87 |
| 4,454,857 | 6/1984 | Miller et al. | 124/87 |
| 4,552,121 | 11/1985 | Treaster | 124/90 |
| 4,563,821 | 1/1986 | Saunders | 33/265 |
| 4,625,422 | 12/1986 | Carlson | 33/265 |
| 4,656,746 | 4/1987 | Gillespie | 124/87 |
| 4,656,747 | 4/1987 | Troncoso | 33/265 |
| 4,726,123 | 2/1988 | Keller | 33/265 |

*Primary Examiner*—Randolph A. Reese
*Assistant Examiner*—Carol I. Bordas
*Attorney, Agent, or Firm*—Litman, McMahon & Brown

[57] ABSTRACT

An archery peep sight apparatus with a sight mechanism in the form of a polyhedron adapted to be mounted in strands of an archery bowstring for sighting an arrow on a target. The polyhedron shaped peep sight has centrally located sight openings in each of four vertical faces parallel to a longitudinal axis of the bowstring. A peep sight turner for use with the peep sight mechanism and generally in the shape of a hexagonal disc is adapted for mounting on the bowstring at a position generally above a nocking point of the bowstring but below the peep sight mechanism. The peep sight mechanism is used to establish proper arrow trajectory even after the peep sight rotates out of its original line of sight alignment during the process of drawing the bow string into a cocked position. The peep sight turner is used to adjust the line of sight alignment of the peep sight to obtain the optimum viewing characteristics of the peep sight which may have rotated during the drawing process.

12 Claims, 1 Drawing Sheet

PEEP SIGHT WITH PEEP TURNER FOR A BOW

BACKGROUND OF THE INVENTION

The present invention relates to sighting apparatus for archery bows, and more particularly, to a peep sight mechanism and peep sight turner associated with a bow string used by an archer on a fully drawn bow string to compensate for the adverse effects on optimum peep sight alignment caused by the rotation or twisting of the bowstring as it is drawn.

An archer, in operating a bow, mounts a nock of an arrow at a nocking point on a bowstring of the bow prior to drawing the bowstring. A shaft of the arrow is mounted on an arrow rest positioned generally at a midpoint on one side of the bow. The archer then draws the bowstring back generally using the fingers of one hand while holding the bow with the opposite hand. Traditionally, to establish proper arrow trajectory once the bowstring is fully drawn, the archer typically placed the hand gripping the bowstring at a reference point on or near the archer's face and also aligns his or her eye directly behind a vertical plane defined by a plane passing through the side of the bow against which the arrow is rested and the drawn bowstring for target sighting.

Such a target sighting process was prone to error. To improve the accuracy and precision of the sighting process, bows and bowstrings were provided with various sighting devices to assist the archer in establishing proper arrow trajectory.

Such sighting devices have included sighting pins for installation on the bow and peep sights for installation in or on the bow string. Sighting pins are adjustably mounted on and extend horizontally from the bow at a preset position above the arrow rest and are used in conjunction with a peep sight mounted in spaced relation above the nocking point so as to be in the line of sight of the archer. Thus, use of peep sights and sighting pins improved the archers ability to establish proper arrow alignment and trajectory.

In practice, however, traditional peep sights have been difficult to use. The bowstring in or on which the peep sight is mounted tends to twist or rotate across the archer's fingers as the bowstring is drawn rearwardly. Such a bowstring rotation, no matter how slight, will tend to misalign the opening of a conventional peep sight in relation to optimum alignment of the peep sight. Often the bowstring rotation is sufficient to completely prevent the use of the peep sight for sighting the target. Further, because both of the archer's hands and arms are in use in holding the bow in the fully drawn and cocked position, the archer's hands are generally not free to adjust the alignment of the peep sight.

Various devices are taught by the prior art to overcome such a problem. The Topel U.S. Pat. No. 4,116,194 discloses a peep sight mounted in a bowstring and connected by an elastic cord to a bow. As the bowstring is drawn, the elastic cord stretches and exerts force upon the peep sight to maintain the peep sight in proper alignment for viewing of the target. Such an elastic cord presents particular problems when used with a compound bow having a lattice of bowstrings through which the elastic cord must be threaded. As such, the elastic cord tends to become tangled or bound in the lattice of compound bowstrings when the bowstring is released. Further, when used with a compound bow, the elastic cord impinges on the bowstrings when the bowstring is released and increases a noise level which is desirable to maintain at a very low level while hunting. Even when used with a conventional recurve bow, the elastic cord tends to unevenly distribute the forces normally imposed on the arrow at the knocking point by the bowstring in the drawn position, causing unpredictable effects on trajectory.

The Miller U.S. Pat. No. 4,454,857 discloses an apparatus which also attempts to overcome the problem in peep sight misalignment caused by the rotation of the bowstring during drawing of the bow. The Miller patent discloses a peep sight having the form of a disc with an elongated hollow hub tightly receiving the bowstrings and connected by spokes to the outer rim of the peep sight. However, because the peep sight openings for sighting the target are the openings between the spokes of the apparatus, when the bowstring is fully drawn, the archer must tilt his head in order to view the target past both the string and the elongated hollow hub which tightly receives the bowstring. Thus, the archer's line of sight is offset and is angular with respect to the axis of the arrow. Such a peep sight apparatus, therefore, creates a source of error for which the archer must compensate in addition to other factors such as distance, elevation, and wind.

The Fletcher U.S. Pat. No. 4,011,853 discloses a peep sight apparatus having the general shape of a disc with a centrally positioned frusto-conical shaped peep sight opening. The apparatus disclosed in the Fletcher patent may be used for sighting targets when it is up to 50 degrees out of optimum alignment. When the Fletcher apparatus is greater than 50 degrees out of alignment, the target can no longer be viewed through the apparatus by aligning the target with the sighting pins. Further, because the small opening positioned at the bottom of the semiconical depression is relatively small, the effective opening for sighting the target is reduced in proportion to the misalignment of the peep sight and the target blurs well before reaching a misalignment of 50 degrees.

Accordingly, it is highly desirable to provide a peep sight apparatus providing a plurality of openings which may generally be used to sight a target, even after the peep sight has rotated with the bowstring in excess of 50 degrees during the drawing of the bow string. It is also highly desirable to provide a peep sight apparatus which can be conveniently adjusted by the archer while the archer holds the bowstring fully drawn prior to release of the arrow.

SUMMARY OF THE INVENTION

The present invention generally alleviates the misalignment problems associated with use of prior art peep sight devices.

The present invention comprises a single-bodied peep sight generally in the shape of a polyhedron. A preferred polyhedron has a horizontal cross section in the shape of a cross and four vertically aligned walls positioned at ninety degrees relative to adjacent walls. The polyhedron is generally hollow and has a plurality of openings communicating radially with each of four parallel vertical faces located in respective walls.

A plurality of bowstring strand slots are positioned at each of intersections of each of the four vertical faces of the polyhedron. Once the polyhedron is mounted in the bowstring with the slots receiving each of four groups of bowstring strands, the peep sight will be positioned generally at the locus of the archer's line of sight. The peep sight may be used to sight the target even after the peep sight has undergone generally any degree of re-alignment due to the rotation of the bow string during the process of drawing the bow string into the cocked position for releasing the arrow.

The peep sight cooperates with a peep sight turner apparatus which has the form of a hexagon-shaped disc. An elongated hollow stem is located centrally in the disc for tightly receiving the bowstring. The peep sight turner is capable of rotating the bow string when the archer causes the peep sight turner to rotate by inducing frictional engagement of the turner with a surface of an archer's face. The turner is used by the archer to obtain the optimum line of sight alignment of the peep sight.

In the present embodiment, the peep turner is mounted on the strands of the bowstring in spaced relation above the nocking point. The peep sight is mounted in the bowstring in spaced relation above the peep turner.

OBJECTS OF THE INVENTION

The principal objects of the present invention are: to provide an improved peep sight apparatus; to provide such an apparatus which can be used generally independent of the extent of bowstring rotation occuring when the bowstring is drawn; to provide a peep sight with openings which intersect the longitudinal axis of the bowstring; to provide an apparatus for adjusting the peep sight line of sight alignment by the archer while the bowstring is fully drawn; and to provide such an apparatus which is relatively easy to manufacture, relatively inexpensive to produce and that is particularly well adapted for the intended usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figures 1, 2, 3, 4, 5, 6, 7:
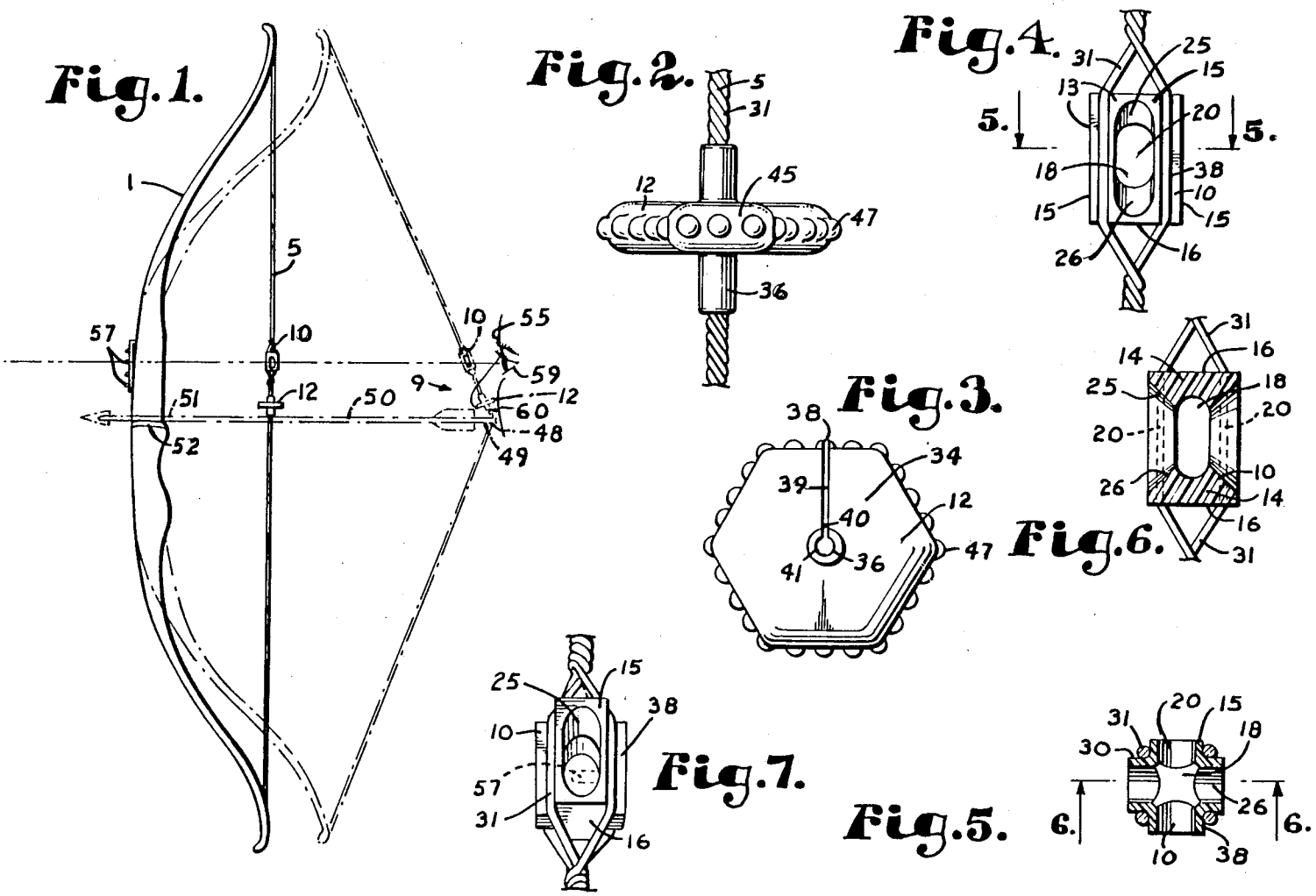
FIG. 1 is a side elevational view of a bow in an undrawn position having a peep sight and a peep sight turner apparatus mounted on the bowstring in accordance with the present invention and showing the bow in phantom in a drawn and cocked position.
FIG. 2 is an enlarged rear elevational view of the peep sight turner mounted on a bowstring.
FIG. 3 is an enlarged top plan view of the peep sight turner.
FIG. 4 is an enlarged, fragmentary and rear elevational view of the peep sight mounted in strands of the bowtring.
FIG. 5 is an enlarged, fragmentary and cross-sectional view of this peep sight and bowstring taken along line 5—5 of FIG. 4.
FIG. 6 is an enlarged, fragmentary and cross-sectional view of the peep sight and the bowstring, taken along line 6—6 of FIG. 5.
FIG. 7 is an enlarged, fragmentary and perspective view of the peep sight mounted in a fully drawn bowstring and showing a pin sight mounted on the bow as it might appear to an archer viewing a target through the peep sight.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a bow which is equiped with a bowstring 5. In accordance with the present invention, mounted in or on the bowstring 5 is a peep sight assembly 9 which comprises a peep sight 10 and a peep sight turner 12.

In the present embodiment, the peep sight 10 is generally rectangular shaped and, when mounted in a vertical bowstring, has four major vertical walls 13 and a pair of horizontal walls 14. Each of the walls 13 has a vertical face 15 and each of the horizontal walls has a horiztonal face 16. However, it is foreseen that the peep sight 10 may be adapted with other shapes with more or less than four vertical faces. The peep sight 10 further comprises a hollow centrally located chamber 18 which communicates with openings 20 centrally positioned in each of the four vertical faces 15. The openings 20 radiate at ninety degrees relative to one another from a common central point in the center of the chamber 18. The hollow chamber 18 has upper beveled surfaces 25 and lower beveled surfaces 26 communicating with each opening 20. The upper beveled surfaces 25 and lower beveled surfaces 26 are provided to maximize the viewing area available to the archer when the peep sight 10 is in an angular orientation, (such as that shown in FIG. 7). However, it is foreseen that the upper and lower surfaces of the hollow chamber 18 may be close to and parallel to the horizontal faces 16 particularly if stronger materials of construction are used. Strand slots 30 are positioned at the intersection of adjacent vertical faces 15 for receiving a plurality of bowstrands 31 that form the bow string 5.

The peep sight turner 12 comprises a disc portion 34 having an elongated hollow and centrally positioned stem 36. It is also foreseen that the peep sight turner 12 may comprise any shape which is capable of rotating the bowstring by frictional engagement of the turner 12 with the archers face. The longitudinal axis of the stem 36 is parallel to and co-axial with the central axis of the disc portion 34. In the present embodiment, the disc portion 34 is centrally spaced along the longitudinal axis of the hollow stem 36. The peep sight turner 12 is provided with a string mounting slot 38 having a disc portion slot 39 communicating with a stem portion slot 40. The stem 36 has a central bore 41 communicating with the slots 38, 39 and 40. When the turner 12 is mounted, the bowstring 5 is passed through the string mounting slot 38, the disc portion slot 39, stem portion slot 40, and into the bore 41 where it is tightly received. An outer radial surface 45 of the disc portion 34 is in the shape of a hexagon. Protruding outwardly from the outer radial surface 45 are a plurality of friction nodes 47. The hexagon shape of the outer radial surface 45 and the friction nodes 47 are provided to improve the frictional engagement qualities of the turner 12.

The peep sight 10 is nested in the bowstring strands 31 at a position in proximity to the archer's eye 59 when the string 5 is drawn. For mounting of the peep sight 10, the strands 31 are separated into four groups, each group to be mounted in one of four string mounting slots 30.

The peep sight turner 12 is mounted in spaced relation between a nocking point 48 of the string 5 and the mounted peep sight 10. The nocking point 48 corresponds to that position on the string 5 where the nock 49 of an arrow 50 is mounted to the string 5 and is generally in midposition on the string 5.

Referring to FIG. 1, when the bowstring 5 is fully drawn (shown in phantom), with the nock 49 of an arrow 50 mounted on the string 5 at the nocking point 48, and an arrow shaft 51 of arrow 50 (shown in phantom) nested on an arrow rest 52 of the bow 1, an archer 55 may sight the target through the peep sight 10 by alignment of the target with an appropriate pin 57 selected to adjust for the distance of the target. FIG. 7 shows (in phantom) how a pin 57 may appear to the archer 55 in the peep sight 10 when the peep sight 10 is in an optimum alignment.

If the peep sight assembly 10 is misaligned after the bowstring 5 is fully drawn, the archer 55 may realign the peep sight 10 by dragging the outer radial surface 45 of the peep sight turner 12 along any contacting surface on the archer's face such as the archer's nose or cheek. The frictional engagement of the outer radial surface 45 on the archer's face causes the turner 12 to rotate which, in turn, causes the bowstring 5 and peep sight 10 to rotate.

The friction nodes 47 are provided on the outer radial surface 45 to enhance the gripping action of the peep sight turner 12 on the face of the archer 55.

Since the peep sight assembly 10 has four vertical faces 15 with each face 15 positioned at 90° to the next adjacent face and each with individual openings 20, the peep sight assembly 10 may never be greater than 45° out of perfect alignment and the openings 20 ar sized such that, even when out of perfect alignment, a line of sight is possible through the peep sight 10 and by rotating the peep sight turner 12 across only small distances on the archer's cheek the peep sight 10 will be effectively adjusted into optimum alignment.

It is to be understood that while certain forms of the present invention have been illustrated and described herein, it is not to be limited to the specific forms or arrangement of parts described and shown.

What is claimed and desired to be secured by Letters Patent is as follows:

1. A peep sight apparatus for use in archery including:

(a) a single-body sight means for mounting in the strands of a bowstring generally at the locus of an archer's line of sight;

(b) said sight means providing a plurality of viewing paths for allowing a target to be sighted by an archer when the bowstring is drawn proximate to an eye of the archer; and (c) said sight means including a plurality of openings, one for each viewing path, said openings angularly spaced about a central axis of at least one of said openings allows a target to be sighted by an archer after the sight means has undergone generally any degree of realignment due to the rotation of the apparatus during the drawing of an associated bow string into a cocked position.

2. The peep sight apparatus according to claim 1 wherein:

(a) said single-body peep sight means is in the general form of a polyhedron having four generally vertical faces when said sight means is mounted in a vertical bowstring; said polyhedron having an internal chamber communicating with said openings that are centrally positioned in each of said four vertical faces; and (b) said internal chamber and said openings cooperating to provide a plurality of viewing paths for sighting the target.

3. The peep sight apparatus according to claim 2 including:

(a) a bow having a bow string with strands; and (b) said strands of the bow string are positioned in a plurality of strand slots located at a vertical intersection of each vertical face of said singlebody peep sight means.

4. A peep sight apparatus for use in archery including:

(a) a single-body sight means for mounting in the strands of a bowstring generally at the locus of an archer's line of sight;

(b) said sight means providing a viewing path for allowing a target to be sighted by an archer when the bowstring is drawn proximate to an eye of the archer;

(c) said sight means including a plurality of openings through which a target may be sighted by an archer after the sight means has undergone generally any degree of realignment due to the rotation of the apparatus during the drawing of an associated bow string into a cocked position;

(d) turning means for mounting on a bowstring in spaced relation to said peep sight means for use in adjustment of the alignment of the peep sight means by the archer when the bowstring is fully drawn; and (e) said turning means adapted to rotate the bowstring when said turning means is caused to rotate by frictional engagement of said turning means with a surface of an archer's face.

5. The apparatus according to claim 4 wherein:

(a) said peep sight turning means is mainly disc shaped and has a central, elongated hollow hub portion extending in perpendicular relationship to a said disc for tightly receiving the bowstring.

6. The apparatus according to claim 5 wherein:

(a) a radially outer surface of said disc is generally in the shape of a hexagon.

7. The apparatus according to claim 5 wherein:

(a) said disc has a radially outer surface on which is positioned a friction means for improving frictional engagement of the turner means on the archer's face.

8. The apparatus according to claim 7 wherein:

(a) said friction means comprises a plurality of friction nodes equadistantly spaced along the radially outer surface of said disc.

9. A peep sight turner for use in cooperation with a peep sight mounted on an archery bowstring; said turner for mounting on the bowstring in spaced relation to the peep sight for use in adjustment of the alignment of the peep sight by an archer when the bowstring is fully drawn; said turner comprising:

(a) turning means adapted to be mounted on said bowstring so as to extend radially outward from said bowstring and being adapted to rotate the bowstring when said turning means is rotated by frictional engagement with surface of an archer's face.

10. The turner according to claim 9 wherein:

(a) said turning means comprises a disc snugly and axially mountable upon the bowstring in a central bore accessible through a slot in said disc.

11. A peep sight apparatus for use in archery comprising (a) peep sight means adapted to be secured to strands of a bowstring;

(b) peep sight turner means; said peep sight means cooperating with said turner means; and (c) said turner means being disc shaped with an elongated hollow hub portion extending axially through said disc and adapted to tightly receive the bowstring, wherein said turner means is adapted to be used for the adjustment of the alignment of the peep sight means by the archer when the bowstring is fully drawn.

12. A peep sight apparatus for use with a bow having bowstring in archery including:

(a) a single body sight means for positioning in strands of the bowstring generally at the locus of an archer's line of sight when aiming;

(b) said sight means providing a viewing path adapted to allow a target to be sighted by an archer when the bowstring is drawn proximate to the archer's eye;

(c) said peep sight means including a plurality of radial openings for use in allowing the archer to sight a target after the sight means have undergone generally any degree of realignment due to the rotation of the bowstring during the process of drawing the bowstring into a cocked position for releasing an arrow;

(d) said sight means having the general form of a polyhedron with four generally vertical faces; said sight means having a hollow internal chamber communicating with the openings centrally positioned in each of said four vertical faces;

(e) said internal chamber and openings cooperating to provide a plurality of viewing paths for sighting a target; said sight means having strand slots located at each vertical intersection of adjacent pairs of vertical faces for receiving strands of the bowstring;

(f) said peep sight apparatus further including turning means for mounting on the bowstring in spaced relation to said sight means for use in adjustment of the alignment of said sight means by the archer when the bowstring is fully drawn;

(g) said turning means being adapted to rotate the bowstring when said turning means is rotated through frictional engagement of the turning means with the surface of an archer's face;

(h) said turning means being disc shaped with an elongated hollow hub portion axially extending relative to said disc for tightly receiving the bowstring;

(i) said turning means having a radially outer surface generally in the form of a hexagon; and (j) said outer surface having frictional means comprising friction nodes equidistantly spaced along said outer radial surface of said disc for improving a frictional engagement of the turning means on the archer's face.

* * * * *